US012251035B2

(12) United States Patent
Spivey et al.

(10) Patent No.: US 12,251,035 B2
(45) **Date of Patent: *Mar. 18, 2025**

(54) INSULATED DRINKING VESSEL WITH MULTIFUNCTION LID

(71) Applicant: Base Brands, LLC, Atlanta, GA (US)

(72) Inventors: Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 1 day.

This patent is subject to a terminal disclaimer.

(21) Appl. No.: 18/354,479

(22) Filed: Jul. 18, 2023

(65) Prior Publication Data

US 2023/0355013 A1 Nov. 9, 2023

Related U.S. Application Data

(63) Continuation of application No. 17/702,420, filed on Mar. 23, 2022, now Pat. No. 11,771,250, which is a (Continued)

(51) Int. Cl.
*A47G 19/22* (2006.01)
*B65D 43/02* (2006.01)

(Continued)

(52) U.S. Cl.
CPC ..... *A47G 19/2288* (2013.01); *A47G 19/2272* (2013.01); *B65D 43/02* (2013.01);

(Continued)

(58) Field of Classification Search
CPC ..... A47G 19/2288; A47G 19/2272; B65D 43/02; B65D 43/16; B65D 43/22;

(Continued)

(56) References Cited

U.S. PATENT DOCUMENTS 2,304,214 A 12/1942 Straub
3,059,816 A 10/1962 Goldstein (Continued)

OTHER PUBLICATIONS

Reduce website, Hot Tumbler, Publication date unknown [site visited Feb. 19, 2019], Available on the Internet URL https://reduceeveryday.com/collections/leisure-hot/products/hot-1-tumbler-16oz.

(Continued)

*Primary Examiner* — Andrew D Perreault
(74) *Attorney, Agent, or Firm* — Park, Vaughan, Fleming & Dowler LLP

(57) ABSTRACT

The present embodiments describe an insulated drinking vessel with a multifunction lid. In an embodiment, the drinking vessel can be configured to receive a multifunction lid. The multifunction lid may, in one embodiment, include an opening for receiving a drinking straw. In an embodiment, the multifunction lid may additionally include an opening for drinking or sipping directly through the lid. In an embodiment, the lid may include an operable cover for covering at least one of the openings in a first position and for allowing access to the fluid through the opening in a second position. In a further embodiment, the lid may include a plurality of operable covers. A first operable cover may be configured for covering the drinking straw opening in a first position and allowing insertion of a straw in a second position. The lid may also include an operable cover for covering the sipping spout in a first position and allowing drinking directly through the spout in a second position.

38 Claims, 8 Drawing Sheets

Related U.S. Application Data continuation of application No. 15/076,910, filed on Mar. 22, 2016, now Pat. No. 11,589,695.

(51) Int. Cl.

| | |
|---|---|
| ***B65D 43/16*** | (2006.01) |
| ***B65D 43/22*** | (2006.01) |
| ***B65D 47/08*** | (2006.01) |
| ***B65D 51/18*** | (2006.01) |
| ***B65D 81/38*** | (2006.01) |

(52) U.S. Cl.

CPC ..... *B65D 43/16* (2013.01); *B65D 43/161* (2013.01); *B65D 43/22* (2013.01); *B65D 47/0833* (2013.01); *B65D 51/18* (2013.01); *B65D 81/3865* (2013.01); *B65D 2543/00046* (2013.01)

(58) Field of Classification Search

CPC ..... B65D 81/3865; B65D 2543/00046; B65D 47/08; B65D 47/0804; B65D 47/0809; B65D 47/0814; B65D 47/0819; B65D 47/0823; B65D 47/0828; B65D 47/0833; B65D 47/0838; B65D 47/0842; B65D 47/0852; B65D 47/0857; B65D 43/161; B65D 51/18; B65D 2231/022; B65D 43/022; B65D 81/3869; B65D 81/3872; B65D 2543/00092; B65D 2543/00296; B65D 2543/00518; B65D 2543/00546; B65D 2543/00564

USPC ..... 220/592.17, 254.6, 259.2, 259.1, 220/254.3–254.5; 222/545

See application file for complete search history.

(56) References Cited

U.S. PATENT DOCUMENTS

| | | | |
|---|---|---|---|
| 3,061,151 | A | 10/1962 | Clare |
| 4,040,549 | A | 8/1977 | Sadler |
| 4,545,508 | A | 10/1985 | Cribb, Jr. et al. |
| D295,831 | S | 5/1988 | Urion |
| 5,086,941 | A | 2/1992 | English et al. |
| 5,203,467 | A | 4/1993 | Tucker |
| 5,244,113 | A | 9/1993 | Stymiest |
| 5,294,014 | A | 3/1994 | Wyatt |
| 5,413,257 | A | 5/1995 | Amberger et al. |
| 5,415,312 | A | 5/1995 | Mueller |
| 5,462,189 | A | 10/1995 | Pierce |
| 5,653,124 | A | 8/1997 | Weber |
| D386,948 | S | 12/1997 | Wissinger |
| D398,187 | S | 9/1998 | Parker |
| D416,755 | S | 11/1999 | Trombly |
| 6,098,834 | A | 8/2000 | Hatsumoto |
| 6,382,476 | B1 | 5/2002 | Randall et al. |
| D481,591 | S | 11/2003 | Lin |
| D485,759 | S | 1/2004 | Janky et al. |
| 6,752,287 | B1 | 6/2004 | Lin |
| D493,068 | S | 7/2004 | Slater |
| 7,021,481 | B2 | 4/2006 | St. Germain et al. |
| D539,609 | S | 4/2007 | Ying |
| D565,901 | S | 4/2008 | Edelstein |
| D577,548 | S | 9/2008 | Homma |
| D584,106 | S | 1/2009 | Wong |
| D589,747 | S | 4/2009 | Wong |
| D591,103 | S | 4/2009 | Wong |
| D600,071 | S | 9/2009 | Carreno |
| D600,073 | S | 9/2009 | Carreno |
| D625,951 | S | 10/2010 | Baek |
| 7,918,359 | B2 | 4/2011 | Paris et al. |
| D643,245 | S | 8/2011 | Minarsch |
| D644,060 | S | 8/2011 | Komeiji |
| D647,753 | S | 11/2011 | Lin |
| D655,967 | S * | 3/2012 | Bodum ..... D7/412 |
| D688,092 | S | 8/2013 | Arnold |
| D691,416 | S | 10/2013 | Eyal |
| D692,756 | S | 11/2013 | McClellan et al. |
| D696,940 | S | 1/2014 | Hale |
| 8,672,174 | B1 * | 3/2014 | McMullin ..... B65D 47/305 222/533 |
| D713,686 | S | 9/2014 | Eyal |
| D715,100 | S | 10/2014 | Eyal |
| D717,115 | S | 11/2014 | Lane et al. |
| D719,023 | S | 12/2014 | Hu |
| 8,899,440 | B2 | 12/2014 | Arnold |
| D721,535 | S | 1/2015 | Chapman |
| D721,540 | S | 1/2015 | Grcic |
| D731,251 | S | 6/2015 | Lane |
| D747,199 | S | 1/2016 | Phillips |
| D747,649 | S | 1/2016 | Phillips |
| D751,338 | S | 3/2016 | Seiders |
| D751,339 | S | 3/2016 | Seiders |
| D751,340 | S | 3/2016 | Seiders |
| D751,347 | S | 3/2016 | Seiders |
| 9,398,822 | B2 | 7/2016 | Wille |
| D788,583 | S | 6/2017 | Tu |
| D789,737 | S | 6/2017 | Eyal |
| D802,362 | S | 11/2017 | Spivey et al. |
| D803,619 | S | 11/2017 | Seiders et al. |
| D803,623 | S | 11/2017 | Bodum |
| D803,684 | S | 11/2017 | Seiders et al. |
| D804,905 | S | 12/2017 | Seiders et al. |
| D814,240 | S | 4/2018 | Kabalin |
| D815,893 | S | 4/2018 | Seiders et al. |
| D819,406 | S | 6/2018 | Rivera |
| D820,045 | S | 6/2018 | Harrington, III et al. |
| D821,151 | S | 6/2018 | Lapsker |
| D836,395 | S | 12/2018 | Seiders et al. |
| 10,159,368 | B2 | 12/2018 | Lin |
| D836,974 | S | 1/2019 | Seiders et al. |
| 2003/0071041 | A1 | 4/2003 | Vogel |
| 2003/0168455 | A1 | 9/2003 | Zettle et al. |
| 2005/0045634 | A1 | 3/2005 | Ward et al. |
| 2005/0269325 | A1 | 12/2005 | Belcastro |
| 2006/0043091 | A1 | 3/2006 | Pinelli et al. |
| 2007/0164026 | A1 | 7/2007 | Morrissey et al. |
| 2008/0073343 | A1 | 3/2008 | Shadrach et al. |
| 2010/0200602 | A1 | 8/2010 | Chan |
| 2010/0288782 | A1 | 11/2010 | Lin |
| 2012/0145712 | A1 | 6/2012 | Bratsch |
| 2012/0241454 | A1 | 9/2012 | Dennis |
| 2013/0062358 | A1 | 3/2013 | El-Saden et al. |
| 2013/0200112 | A1 | 8/2013 | Pierre |
| 2013/0320012 | A1 | 12/2013 | Lucas |
| 2014/0263476 | A1 | 9/2014 | Blain et al. |
| 2016/0270572 | A1 | 9/2016 | Karussi et al. |
| 2017/0273484 | A1 | 9/2017 | Spivey et al. |
| 2018/0332987 | A1 | 11/2018 | Lin |

OTHER PUBLICATIONS

Reduce Everyday. Core Mug 12 oz. Aug. 19, 2014 [earliest online date], [site visited May 19, 2017]. Available from Internet, <URL:https://reduceeveryday.com/products/core-mug-12oz>.

Starbucks; "Starbucks Holiday 2013 Candy Twist Tumbler, 12 fl oz", downloaded at https://www.amazon.com/starbucks-holiday-candy-twist-tumbler/dp/b00gpwxc6Q, May 1, 2018.

Starbucks; "Starbucks New Logo Grande Travel Mug/Tumber", downloaded at https://www.amazon.com/starbucks-logo-Grande-Travel_Tumbler/dp/B00RAK5PQ2, May 1, 2018.

Starbucks; Starbucks Stainless Steel Tumbler with Handle—Charcoal, 16 Fl Oz, downloaded at https://www.amazon.com/Starbucks-Stainless Steel-Tumbler_Handle/dp/B00F12IIPQ, May 1, 2018.

Starbucks; "Starbucks DOT Collection Tumbler—Graffiti Green Dot, 16 Fl Oz" downloaded at https://www.amazon.com/Starbucks-DOT-Collection-Tumbler-Graffiti/dp/B00RFOZ5EO, May 1, 2018.

Starbucks; "Starbucks New Logo Tall Travel Mug/Tumbler " down-

(56) References Cited

OTHER PUBLICATIONS loaded at https://www.amazon.com/Starbucks-Logo-Tall-Travel-Tumbler/dp/B00O0L1ARM, May 1, 2018.

* cited by examiner

INSULATED DRINKING VESSEL WITH MULTIFUNCTION LID

PRIORITY CLAIM

This application is a continuation of and claims priority from and the benefit of U.S. patent application Ser. No. 17/702,420, entitled INSULATED DRINKING VESSEL WITH MULTIFUNCTION LID, filed Mar. 23, 2023. U.S. application Ser. No. 17/702,420 is a continuation of and claims priority from and the benefit of U.S. patent application Ser. No. 15/076,910, entitled INSULATED DRINKING VESSEL WITH MULTIFUNCTION LID, filed Mar. 22, 2016, issued as U.S. Pat. No. 11,589,695 on Feb. 28, 2023.

FIELD

This disclosure relates generally to drinking vessels, and more specifically, to an insulated drinking vessel with a multifunction lid.

BACKGROUND

Drinking vessels, such as cups, insulated beverage containers, canteens, and the like are used to contain fluids for drinking. Fluids tend to spill if left in an open container, so many drinking vessels include a lid. Some lids include openings for allowing controlled passage of the fluid to a user of the vessel. In some cases, the opening is a hole or slot for receiving a drinking straw. In other cases, the opening is a hole or slot for sipping directly through the lid. Various forms of such drinking vessels are known in the art. For example, paper disposable cups commonly include a plastic lid with an "X" shaped opening cut in the surface thereof for receiving a drinking straw. Many disposable coffee cups may be covered with a lid that includes a slot or spout for sipping directly through the lid. Such lids often include a secondary hole or opening for allowing passage of air through the lid, thereby equalizing the pressure inside the drinking vessel and the environment outside of the drinking vessel.

Some drinking vessels are insulated to reduce thermal transfer between the fluid contained in the drinking vessel and the external environment. For example, some disposable coffee cups are formed of an insulating material, such as a polymer foam. Other insulated drinking vessels may include an inner vessel and an outer shell, where at least a portion of the outer shell is spaced apart from a portion of the inner vessel. In some insulated drinking vessels, the space between the inner vessel and the outer shell is filled with air. In other cases the space may be filled with an insulating material, such as a fibrous material, a polymer foam material, or the like. In other cases, the space between the inner vessel and the outer shell is vacuum sealed. Known drinking vessels are commonly made from paper, polymers, foam, plastic, metal, and the like.

People often use covered drinking vessels when they are on the move. For example, it may be desirable to cover a drinking vessel when transporting the fluid on foot or in a vehicle. Additionally, it may be desirable to use a covered drinking vessel in the outdoors to prevent contamination of the fluids by dirt, insects, or the like. Because covered drinking vessels may be used in a variety of circumstances, and with a variety of different fluids, it may be useful to have a variety of access options. Unfortunately, drinking vessels are typically only provided with a lid configured for a single mode of access, such as with a straw, or with a drinking spout.

SUMMARY

Embodiments of systems and apparatuses including an insulated drinking vessel with a multifunction lid are described. In an embodiment, an apparatus includes a lid configured to engage an opening of a container, the lid configured to retain the liquid within the container. The apparatus may further include a first opening in the lid for dispensing liquid across a rim of the lid. Additionally, the apparatus may include a second opening in the lid for receiving a drinking straw. The apparatus may also include a first cover for covering the first opening in a first position and for allowing access to the first opening in a second position. Also, the apparatus may include a second cover for covering the second opening in a first position and for allowing access to the second opening in a second position.

An embodiment of a system may include a container for containing liquids, and a lid configured to engage an opening of the container, the lid configured to retain the liquid within the container. The lid may include a first opening for dispensing liquid across a rim of the lid, a second opening for receiving a drinking straw, a first cover for covering the first opening in a first position and for allowing access to the first opening in a second position, and a second cover for covering the second opening in a first position and for allowing access to the second opening in a second position.

BRIEF DESCRIPTION

The following drawings form part of the present specification and are included to further demonstrate certain aspects of the present invention. The invention may be better understood by reference to one or more of these drawings in combination with the detailed description of specific embodiments presented herein.

Figure 9A:
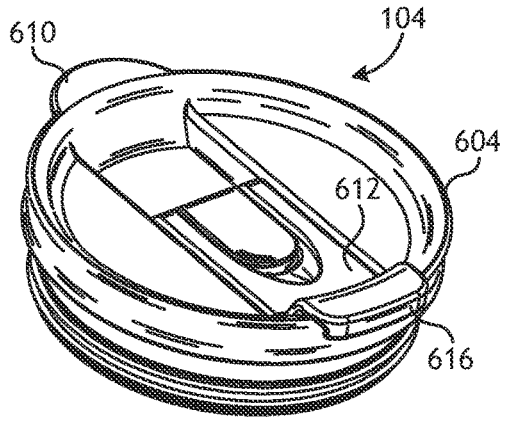

FIG. 9A a top perspective view diagram of one embodiment of a multifunction lid with a cover in a closed position.

Figure 9B:
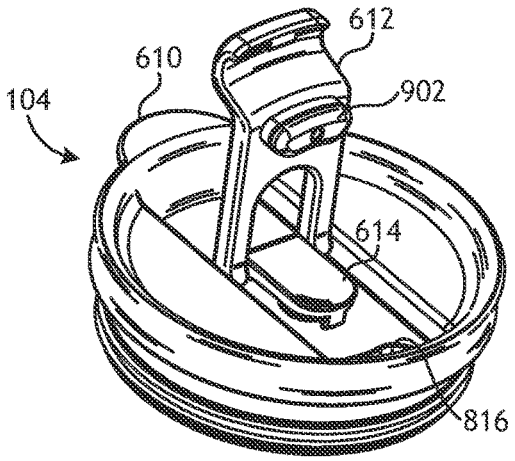

FIG. 9B is a top perspective view diagram of one embodiment of a multifunction lid with a cover in an actuated position.

Figure 9C:
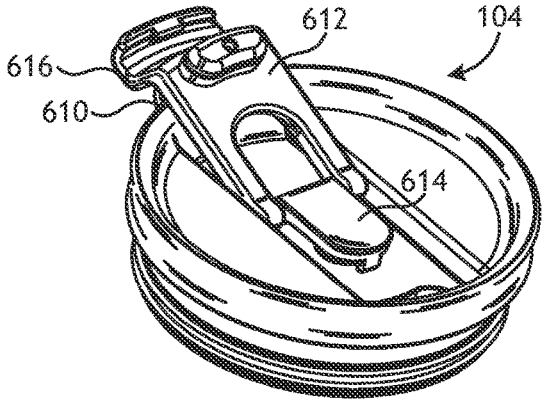

FIG. 9C is a top perspective view diagram of one embodiment of a multifunction lid with a cover in an open position.

Figure 10A:
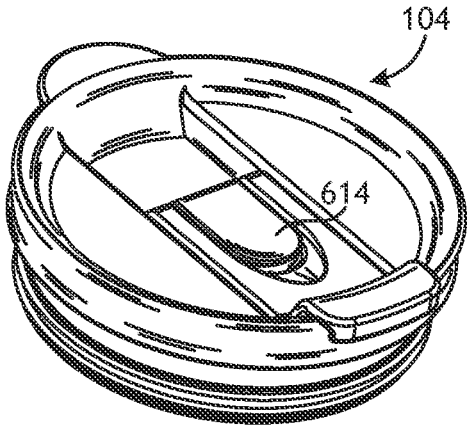

FIG. 10A a top perspective view diagram of one embodiment of a multifunction lid with a cover in a closed position.

Figure 10B:
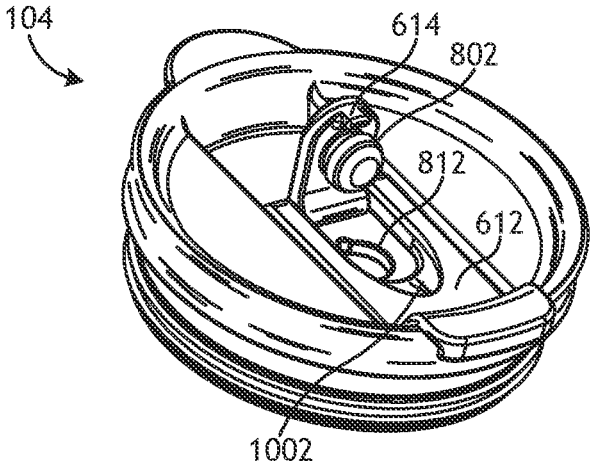

FIG. 10B is a top perspective view diagram of one embodiment of a multifunction lid with a cover in an actuated position.

Figure 10C:
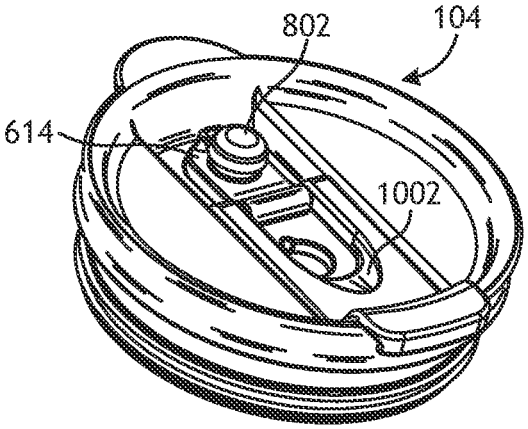

FIG. 10C is a top perspective view diagram of one embodiment of a multifunction lid with a cover in an open position.

Figure 11A:
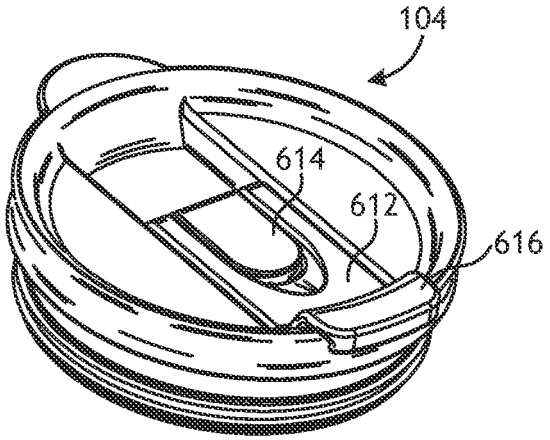

FIG. 11A a top perspective view diagram of one embodiment of a multifunction lid with multiple covers in a closed position.

Figure 11B:
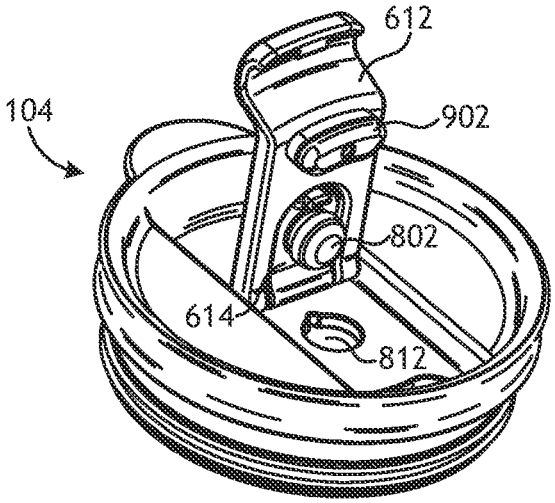

FIG. 11B is a top perspective view diagram of one embodiment of a multifunction lid with multiple covers in an actuated position.

Figure 11C:
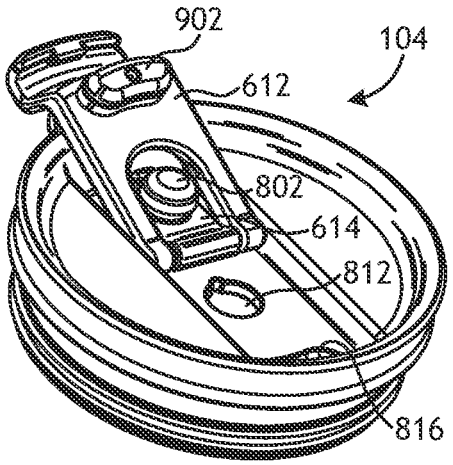

FIG. 11C is a top perspective view diagram of one embodiment of a multifunction lid with multiple covers in an open position.

Figure 12:
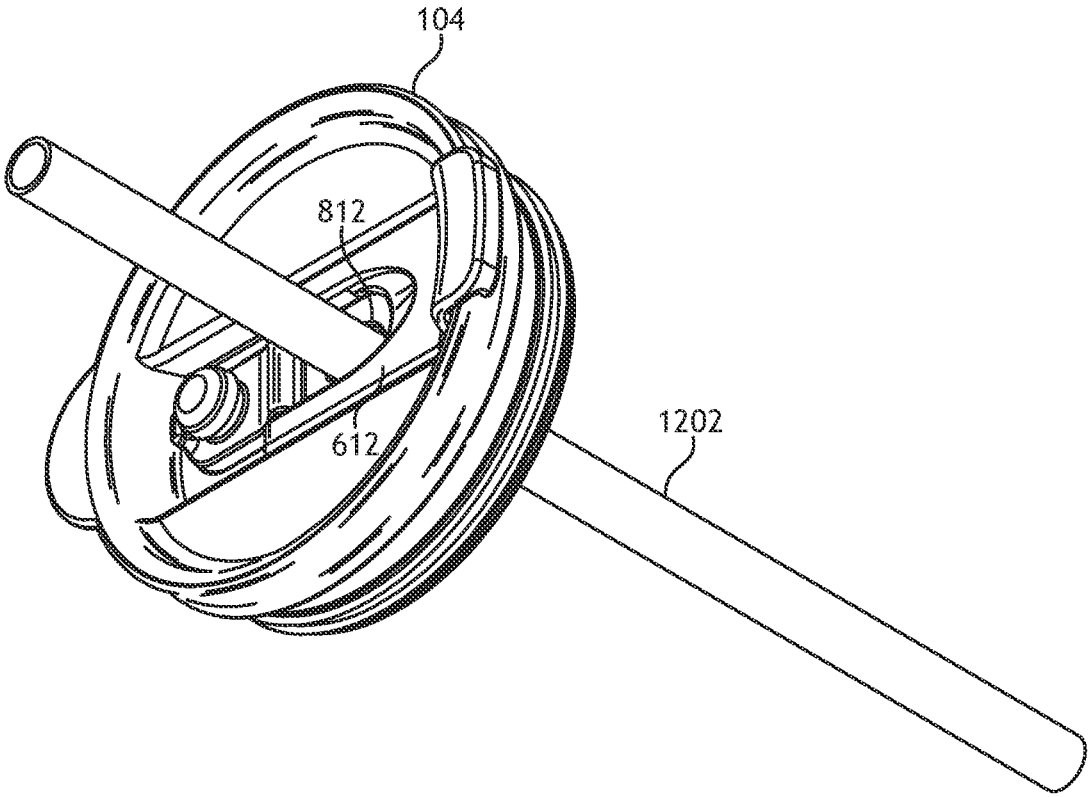

FIG. 12 is a top perspective view diagram of one embodiment of a multifunction lid with a drinking straw inserted therein.

Figure 13:
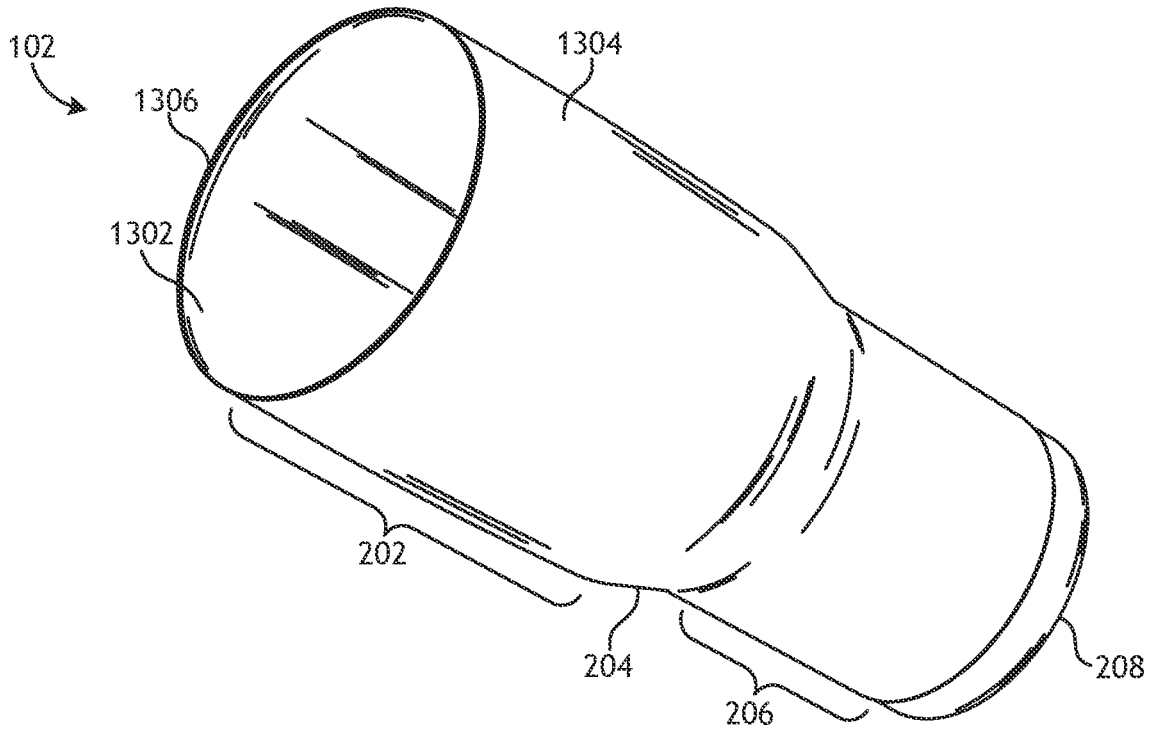

FIG. 13 is a top perspective view diagram of one embodiment of an insulated drinking vessel.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The present embodiments describe an insulated drinking vessel with a multifunction lid. For example, in an embodiment, the insulated drinking vessel may be a tumbler style cup. The tumbler may be formed of stainless steel sheet metal. The drinking vessel may include an inner vessel and an outer shell where at least a portion of the inner vessel is spaced apart from the outer shell, and wherein a space between the inner vessel and the outer shell is vacuum sealed.

In an embodiment, the drinking vessel can be configured to receive a multifunction lid. The multifunction lid may, in one embodiment, include an opening for receiving a drinking straw. In an embodiment, the multifunction lid may additionally include an opening for drinking or sipping directly through the lid. In an embodiment, the lid may include an operable cover for covering at least one of the openings in a first position and for allowing access to the fluid through the opening in a second position. In a further embodiment, the lid may include a plurality of operable covers. A first operable cover may be configured for covering the drinking straw opening in a first position and allowing insertion of a straw in a second position. The lid may also include an operable cover for covering the sipping spout in a first position and allowing drinking directly through the spout in a second position.

In a further embodiment, the multifunction lid may include a raised edge for engaging the lip of a user when the user drinks from the vessel. Beneficially, the smooth surface of the raised edge may provide a superior tactile experience to the user when drinking as compared to the relatively rough surface of the metal drinking vessel. In a further embodiment, the raised edge may be formed with a contour, such as a concave contour, for more fully engaging a lower lip, thereby reducing the tendency for spillage while drinking.

In various embodiments, the multifunction lid may include additional features, such as a vent port for allowing pressure equalization and steady flow of the fluid from the vessel. The lid may also include a flange or handle for removing the lid from the vessel.

Figure 1:
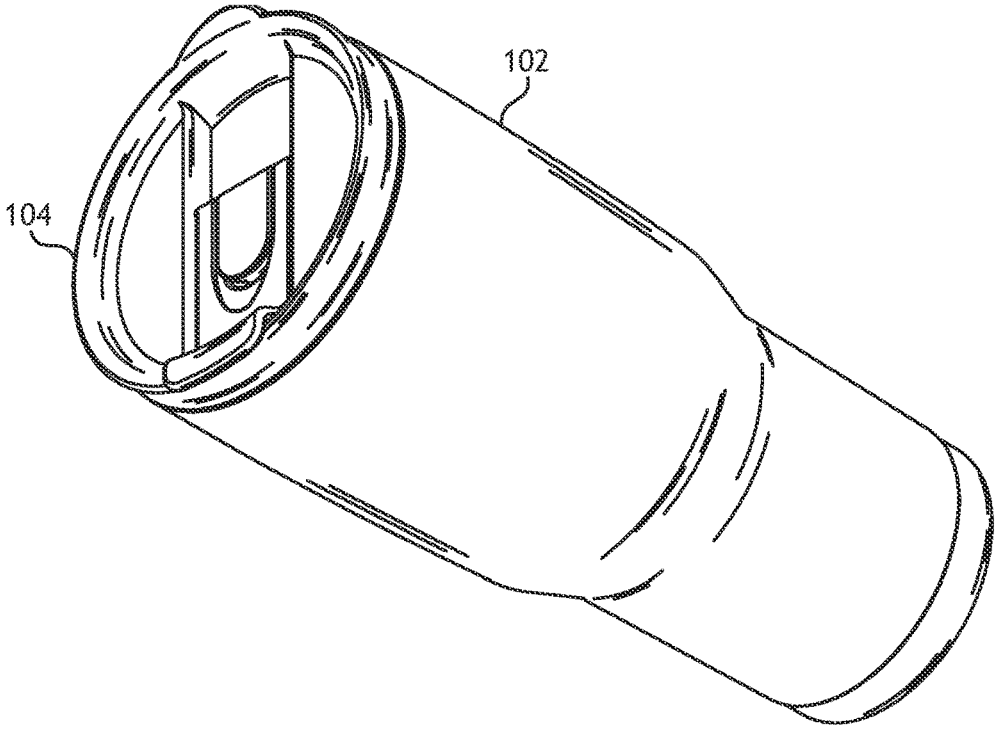
FIG. 1 is a top perspective view diagram of one embodiment of an insulated drinking vessel with a multifunction lid.

FIG. 1 is a top perspective view diagram of one embodiment of an insulated drinking vessel 102 with a multifunction lid 104. In an embodiment, the multifunction lid 104 may engage an interior surface of the vessel 102 when seated. In another embodiment, the multifunction lid 104 may engage an exterior surface of the vessel 102 when seated. Beneficially, the multifunction lid 104 may contain (or keep) a fluid within the vessel 102. The vessel 102 may be insulated to reduce thermal conduction between a fluid contained therein and the external environment. For example, the vessel may be a stainless steel vacuum insulated tumbler.

Figure 2:
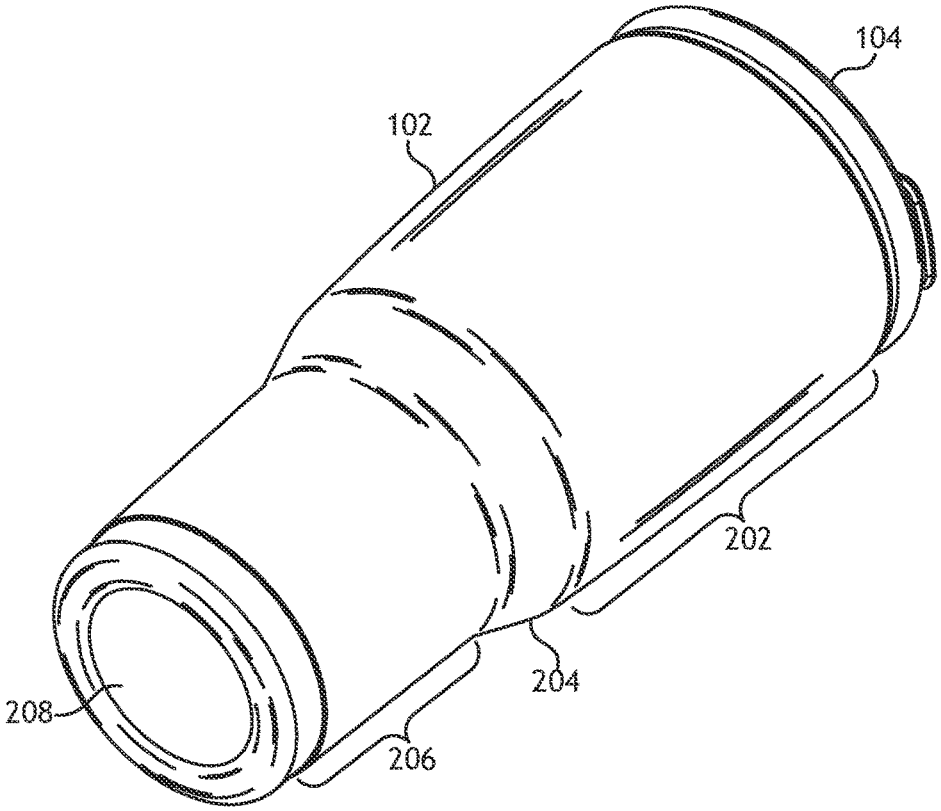
FIG. 2 is a bottom perspective view diagram of one embodiment of an insulated drinking vessel with a multifunction lid.

FIG. 2 is a bottom perspective view diagram of one embodiment of an insulated drinking vessel 102 with a multifunction lid 104. In an embodiment the drinking vessel 102 may include a first portion 202 and a second portion 206, with a transition 204 between the first portion 202 and the second portion 206. In one embodiment, an average outer diameter of the first portion 202 may be greater than an average outer diameter of the second portion 206. More specifically, the outer diameter along the second portion 206 may be within a range that is suitable for fitting in an average cup holder of an automobile. Additionally, the drinking vessel 102 may include a bottom 208.

Figure 3:
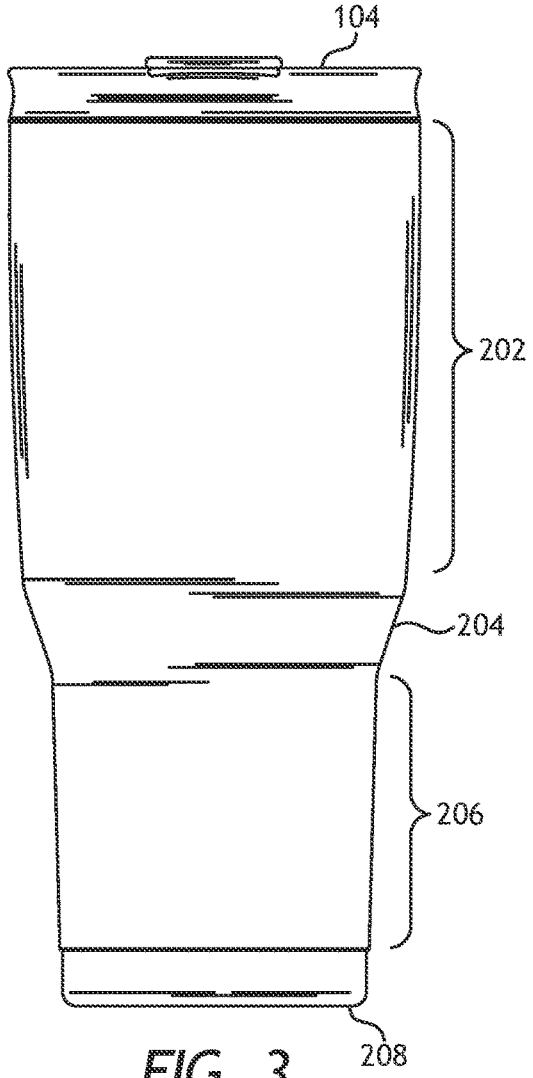
FIG. 3 is a side view diagram of one embodiment of an insulated drinking vessel with a multifunction lid.

FIG. 3 is a side view diagram of one embodiment of an insulated drinking vessel 102 with a multifunction lid 104. The embodiment further illustrates contours of the first portion 202, the second portion 206, and the transition 204. The insulated drinking vessel 102 may be manufactured from one or more sheets of stainless steel, or other metal material, where the ends of the sheet are welded together, or otherwise attached to form a generally cylindrical profile, and a bottom piece 208 is attached to a bottom edge of the cylinder for forming a vessel suitable for holding a fluid.

Figure 4:
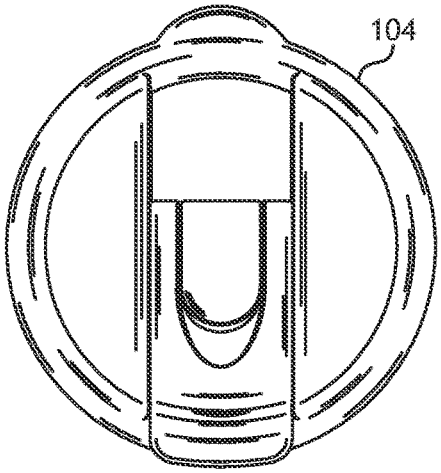
FIG. 4 is a top view diagram of one embodiment of an insulated drinking vessel with a multifunction lid.
Figure 5:
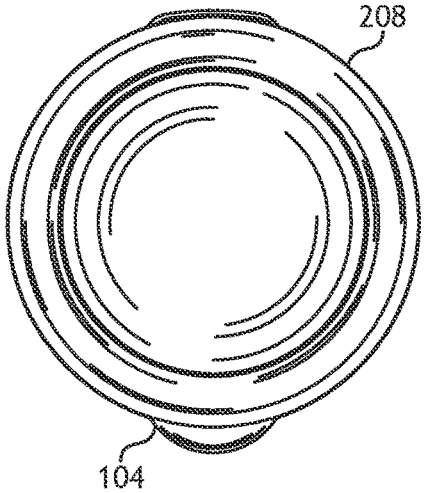
FIG. 5 is a bottom view diagram of one embodiment of an insulated drinking vessel with a multifunction lid.

FIG. 4 is a top view diagram of one embodiment of an insulated drinking vessel 102 with a multifunction lid 104. As shown, the outer diameter of the multifunction lid 104 may be greater than the outer diameter of the vessel 102. FIG. 5 is a bottom view diagram of one embodiment of an insulated drinking vessel 102 with a multifunction lid 104, where the bottom comprises a bottom piece 208. In an alternative embodiment, the bottom and sides of the vessel 102 may be a single piece of material, which has been stamped, pressure formed, forged, extruded, or otherwise formed into the shape of the vessel 102, for example.

Figure 6:
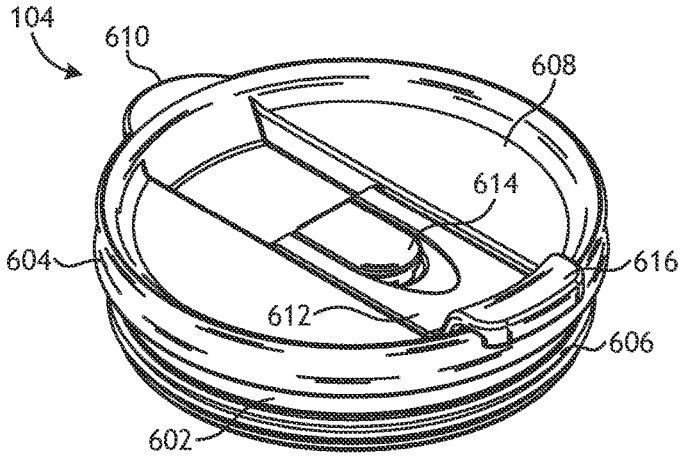
FIG. 6 is a top perspective view diagram of one embodiment of a multifunction lid.

FIG. 6 is a top perspective view diagram of one embodiment of a multifunction lid 104. In an embodiment, the lid 104 includes a body 602 for engaging at least a portion of the vessel 102 and retaining the fluid within the vessel 102. The lid 104 may also include a raised edge 604 suitable for engaging a lip of a user during use. For example, when drinking from the vessel 102 through the lid 104, the user's bottom lip may engage the raised edge 604, rather than the vessel surface, which may be preferable in some embodiments.

The lid 104 may further include one or more sealing members 606 for creating a seal between the body 602 of the lid 104 and a portion of the vessel 102. For example, the sealing member 606 may be an annular rubber or plastic ring, in some embodiments. In particular, multiple sealing members 606 may engage the portion of the vessel 104. In one embodiment, the lid includes two sealing members 606. In an embodiment, a recess 608 may be formed in the upper surface of the lid 104, the recess 608 for retaining liquid inadvertently spilled from the cup through the lid.

In an embodiment, the lid 104 may also include a tab 610 for operating the lid. For example, the tab 610 may be used for grasping the lid 104 to remove it from an opening of the vessel 102.

The lid 104 may also include a first cover 612 for removably covering a drinking spout opening in the vessel 102. Additionally, the lid 104 may include a second cover 614 for removably covering a drinking straw hole in the lid 102. In a further embodiment, the first cover 612 may include a locking mechanism 616 for locking the first cover 612 into a closed or open position. In one embodiment, the locking mechanism 616 may include a flange with a recess and a lip thereon for engaging an edge of the raised edge 604.

Figure 7:
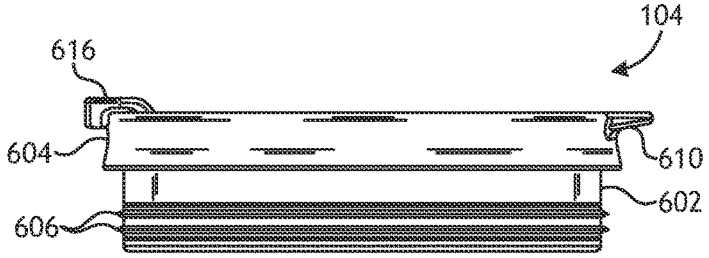
FIG. 7 is a side view diagram of one embodiment of a multifunction lid.

FIG. 7 is a side view diagram of one embodiment of a multifunction lid 104. The embodiment of FIG. 7 further illustrates the contour of the raised edge 604. For example, the raised edge 604 may be concave in shape. Also shown is the tab 610, which may be formed directly on a portion of the raised edge 604. FIG. 7 also shows an embodiment of the sealing member 606, in which the sealing member includes two annular rings applied to the body 602.

Figure 8:
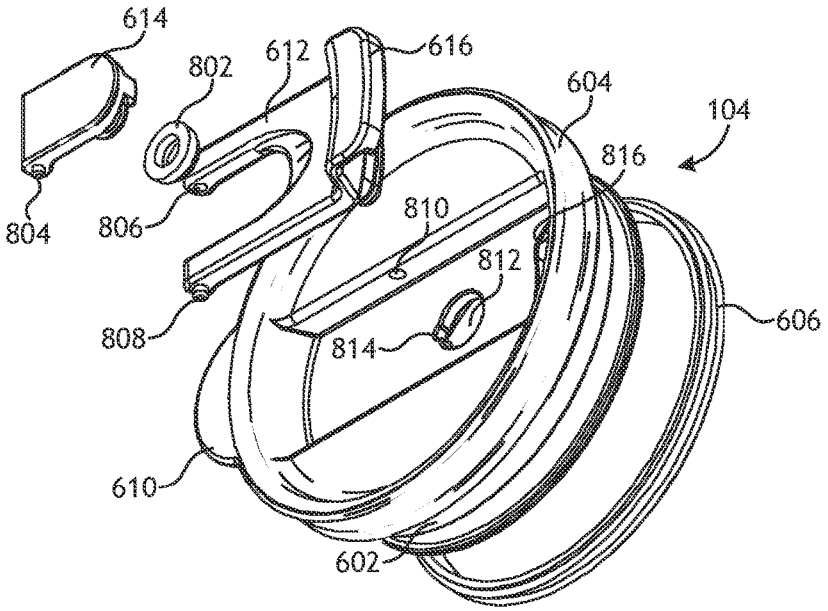
FIG. 8 is an exploded view diagram of one embodiment of a multifunction lid.

FIG. 8 is an exploded view diagram of one embodiment of a multifunction lid 104. In one embodiment, the first cover 612 is attached to the body 602 by one or more pivot pins or tabs 808, which are configured to engage mating pivot receivers 810 in the body 602. For example, the pivot receivers 810 may include one or more holes in a surface of the cover 104. The first cover 612 may be configured to cover the spout opening 816 in the lid 104. Similarly, the second cover 614 may be pivotally coupled to at least one end of the first cover by a pivot pin or tab 804 for engaging a mated receiver 806. In a further embodiment, a seal 802 may be applied to the drinking straw opening 812. A vent port 814 may also be covered, but not completely, by the seal 802 when the second cover 614 is in a closed position.

FIGS. 9A-9C illustrate operation of a first cover 612 of an embodiment of a multifunction lid 104. In FIG. 9A, the first cover 612 is in a closed position, thereby sealing opening 816. FIG. 9B illustrates operation of the first cover 612 over a pivot point, as described in more detail above with respect to FIG. 8. FIG. 9B also illustrates sealing member 902, which is attached to (or formed on) the underside of the first cover 612 in order to seal/close the spout opening 816 when the first cover 612 is closed, so as to prevent liquid from spilling from the vessel 102. FIG. 9C illustrates an embodiment of the first cover 612 in an open position, where the first cover 612 is engaged with the tab 610 to maintain the first cover 612 in the open position. For example, in an embodiment, a groove or slot on a surface of the first cover 612 may be configured to receive an edge portion of the tab 610, thereby maintaining the first cover 612 in the open position.

In FIGS. 10A-C, operation of the second cover 614 is shown. In FIG. 10A, the second cover 614 is in the closed position such that seal 802 covers the straw hole 812. In FIG. 10B, operation of the second cover 614 is shown. In such an embodiment, the second cover 614 may be moved to an open position, as shown in FIG. 10C, while the first cover 612 remains in the closed position. In the embodiments of FIGS. 10B-C, a recessed 1002 is formed in a portion of the first cover 612 to allow access for manipulation of the second cover 614.

FIGS. 11A-C illustrate operations of both the first cover 612 and the second cover 614. In such an embodiment, both the first cover 612 and the second cover 614 may be operated, as shown in FIG. 11B into the open position, as shown in FIG. 11C. In such an embodiment, a user may drink from the spout at a high rate because of the enlarged vent capacity created by opening the straw hole 812 in addition to the vent hole 814 (shown in FIG. 8).

FIG. 12 is a top perspective view diagram of one embodiment of a multifunction lid 104 with a drinking straw 1202 inserted therein. In an embodiment, the drinking straw may be inserted through the straw hole 812 when the second cover 614 is open and the first cover 612 is closed. In such an embodiment, the straw 1202 may extend into an interior portion of the vessel 102.

FIG. 13 is a top perspective view diagram of one embodiment of an insulated drinking vessel 102. The embodiment may include an inner vessel 1302 and an outer shell 1304. The inner vessel 1302 may be spaced apart from the outer shell 1304 and connected at a rim 1306. The space between the inner vessel 1302 and the outer shell 1304 may be vacuum sealed, filled with insulation, filled with air, or the like. The vessel 102 may be shaped in a first portion 202 and a second portion 206, where the average diameter of the second portion is suitable for insertion into an average cup holder of a vehicle. One of ordinary skill will recognize that alternative geometries may be suitable for use according to the present embodiments. In various embodiments, the vessel 102 may be a stainless steel tumbler, cup, mug, or the like. The vessel 102 may be formed to have a variety of inner volumes including, but not limited to 20 oz., 24 oz., 30 oz., 34 oz., 40 oz., 42 oz., 64 oz., and the like.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A drinking apparatus, comprising:

a lid configured to engage an opening of a container for containing a liquid, the lid configured to retain the liquid within the container;

a drinking opening in the lid sized and configured to allow a user to drink from the drinking opening;

a rim on a periphery of the lid having a raised edge around at least a portion of the periphery of the lid, wherein the rim is sized and configured to engage a user's lips and reduce spillage of liquid dispensed from the drinking opening;

a drinking straw opening in the lid comprising a slidably-mounted, single-piece, removable drinking straw that while in the drinking straw opening is accessible for direct contact with a user's lips while drinking from the drinking straw, where the drinking straw opening is spaced laterally apart and separate from the drinking opening in the lid, such that the drinking opening and the drinking straw opening provide independent drinking openings in the lid;

a first cover attached to the lid to move between a first position and a second position relative to the drinking opening, whereby the first cover is configured to preclude liquid from being dispensed from the drinking opening in the first position and to allow liquid to be dispensed from the drinking opening in the second position; and a second cover attached to the lid to move between a first position and a second position relative to the drinking straw opening, whereby the second cover is configured to preclude liquid from being dispensed from the drinking straw opening in the first position and to allow liquid to be dispensed from the drinking straw opening in the second position, whereby the first cover and the second cover are attached to the lid such that movement of the first cover between its first and second position is independent of movement of the second cover between its first and second position, and movement of the second cover between its first and second position is independent of movement of the first cover between its first and second position, and whereby the lid includes an upper most point and a lower most point, and wherein the drinking straw, while in the drinking straw opening, extends above the upper most point and below the lower most point of the lid.

2. The drinking apparatus of claim 1, wherein the lid further comprises a vent opening integrated with the drinking straw opening for pressure equalization when the liquid is dispensed through at least one of the drinking opening or the drinking straw opening.

3. The drinking apparatus of claim 1, wherein the first cover includes a hinge and moves about a first hinged axis.

4. The drinking apparatus of claim 3, wherein the first cover comprises a sealing member configured to seal the drinking opening when the first cover is in its first position.

5. The drinking apparatus of claim 1 further comprising a locking mechanism configured to lock at least one of the first cover and the second cover in the first position.

6. The drinking apparatus of claim 1, wherein the second cover includes a hinge and moves about a second hinged axis.

7. The drinking apparatus of claim 6, wherein the second cover comprises a sealing member configured to seal at least a portion of the drinking straw opening when the second cover is in its first position.

8. The drinking apparatus of claim 1 further comprising a tab on the rim of the lid for facilitating removing the lid from a container.

9. The drinking apparatus of claim 1 wherein the first cover includes a locking mechanism for maintaining the first cover in its first position by engaging the rim of the lid and for maintaining the first cover in its second position by engaging a tab on the rim of the lid.

10. A drinking cup, comprising:

a container for containing liquids;

a lid configured to engage an opening of the container, the lid configured to retain the liquid within the container, wherein the lid comprises:

a drinking opening in the lid for dispensing liquid;

a rim on a periphery of the lid having a raised edge around the periphery of the lid, wherein the rim is sized and shaped for engaging a user's lips and for reducing spillage of liquid when dispensed from the drinking opening;

a drinking straw opening in the lid comprising a slidably-mounted, single-piece, removable drinking straw that while in the drinking straw opening is accessible for direct contact with a user's lips while drinking from the drinking straw, where the drinking straw opening is spaced laterally apart and separate from the drinking opening in the lid, such that the drinking opening and the drinking straw opening provide independent drinking openings in the lid;

a first cover attached to the lid to move between a first position and a second position relative to the drinking opening, whereby the first cover is configured to preclude liquid from being dispensed from the drinking opening in the first position and to allow liquid to be dispensed from the drinking opening in the second position; and a second cover attached to the lid to move between a first position and a second position relative to the drinking straw opening, whereby the second cover is configured to preclude liquid from being dispensed from the drinking straw opening in the first position and to allow liquid to be dispensed from the drinking straw opening in the second position, whereby the lid includes an upper most point and a lower most point, and wherein the drinking straw, while in the drinking straw opening, extends above the upper most point and below the lower most point of the lid.

11. The drinking cup of claim 10, wherein the first cover comprises a sealing member configured to seal the drinking opening when the first cover is in its first position.

12. The drinking cup of claim 10 further comprising a locking mechanism configured to lock at least one of the first cover and the second cover in the first position.

13. The drinking cup of claim 11, wherein the first cover includes a hinge and moves about a first hinged axis.

14. The drinking cup of claim 11, wherein the second cover comprises a sealing member configured to seal at least a portion of the drinking straw opening when the second cover is in its first position.

15. A drinking cup, comprising:

a container for containing liquids;

a lid configured to engage an opening of the container, the lid configured to retain the liquid within the container, wherein the lid comprises:

a drinking opening in the lid for dispensing liquid;

a rim on a periphery of the lid having a raised edge around the periphery of the lid;

a drinking straw opening in the lid comprising a slidably-mounted, single-piece, removable drinking straw that while in the drinking straw opening is accessible for direct contact with a user's lips while drinking from the drinking straw, where the drinking straw opening is spaced laterally apart and separate from the drinking opening in the lid, such that the drinking opening and the drinking straw opening provide independent drinking openings in the lid;

a first cover for fully covering the drinking opening in a first position and for allowing access to the drinking opening in a second position, wherein the first cover includes a first hinge for moving the first cover between its first position and its second position on a first axis;

a second cover for fully covering the drinking straw opening in a first position and for allowing access to the drinking straw opening in a second position, wherein the second cover includes a second hinge for moving the second cover between its first position and its second position on a second axis, whereby the first cover and the second cover are attached to the lid such that movement of the first cover between its first and second position is independent of movement of the second cover between its first and second position, and movement of the second cover between its first and second position is independent of movement of the first cover between its first and second position, wherein the first axis and the second axis comprise the same axis, and whereby the lid includes an upper most point and a lower most point, and wherein the drinking straw, while in the drinking straw opening, extends above the upper most point and below the lower most point of the lid.

16. The drinking cup of claim 15 wherein the first cover comprises a sealing member configured to seal the drinking opening when the first cover is in its first position.

17. The drinking cup of claim 16 wherein the second cover comprises a sealing member configured to seal the drinking straw opening when the second cover is in its first position.

18. The drinking cup of claim 17 wherein the first cover includes a locking mechanism for maintaining the first cover in its first position by engaging the rim of the lid.

19. The drinking cup of claim 15 wherein the second cover is positioned within the first cover when the second cover and the first cover are in their first position.

20. The drinking cup of claim 19 wherein the raised edge around the entire periphery of the lid is sized and configured to engage a lip of a user and reduce spillage of liquid when dispensed from the drinking opening.

21. The drinking cup of claim 19 wherein the first cover includes a recess for accessing the second cover.

22. A lid for a drinking vessel, comprising:

a drinking opening;

a drinking straw opening comprising a slidably-mounted, single-piece, removable drinking straw that while in the drinking straw opening is accessible for direct contact with a user's lips while drinking from the drinking straw, where the drinking straw opening is spaced laterally apart and separate from the drinking opening in the lid, such that the drinking opening and the drinking straw opening provide independent drinking openings in the lid;

a first cover for fully covering the drinking opening in a first position and for allowing access to the drinking opening in a second position, wherein the first cover includes a first hinge for moving the first cover between its first position and its second position on a first axis; and a second cover for fully covering the drinking straw opening in a first position and for allowing access to the drinking straw opening in a second position, wherein the second cover includes a second hinge for moving the second cover between its first position and its second position on a second axis, whereby the first cover and the second cover are attached to the lid such that movement of the first cover between its first and second position is independent of movement of the second cover between its first and second position, and movement of the second cover between its first and second position is independent of movement of the first cover between its first and second position, and whereby the lid includes an upper most point and a lower most point, and wherein the drinking straw, while in the drinking straw opening, extends above the upper most point and below the lower most point of the lid.

23. The lid of claim 22 wherein the first cover comprises a sealing member configured to seal the drinking opening when the first cover is in its first position.

24. The lid of claim 23 wherein the second cover comprises a sealing member configured to seal the drinking straw opening when the second cover is in its first position.

25. The lid of claim 22 wherein the first cover includes a locking mechanism for maintaining the first cover in its first position by engaging a rim of the lid.

26. The lid of claim 24 wherein the second cover is positioned within the first cover when the second cover and the first cover are in their first position.

27. The lid of claim 26 wherein the first cover includes a recess for accessing the second cover.

28. The lid of claim 22 wherein the first axis extends through a first pair of pivot points on the first cover, the second axis extends through a second pair of pivot points on the second cover, and the first axis and the second axis comprise the same axis.

29. The lid of claim 28 wherein the first and the second axis are located proximate a middle of the lid.

30. The lid of claim 28 wherein the first and the second axis are located slightly offset from a center of the lid.

31. The drinking apparatus of claim 1 wherein the first cover includes a locking mechanism for locking the first cover in its first position and maintaining the first cover in its second position.

32. A drinking vessel, comprising:

a lid configured to engage an opening of a container for containing a liquid, the lid configured to retain the liquid within the container;

a drinking opening in the lid sized to allow a user to drink from the drinking opening;

a drinking straw opening comprising a slidably-mounted, single-piece drinking straw that while in the drinking straw opening is accessible for direct contact with a user's lips while drinking from the drinking straw, where the drinking straw opening is spaced laterally apart and separate from the drinking opening in the lid, such that the drinking opening and the drinking straw opening provide independent drinking openings in the lid;

a first cover attached to the lid to move between a first position and a second position relative to the drinking opening, whereby the first cover is configured to preclude liquid from being dispensed from the drinking opening in the first position and to allow liquid to be dispensed from the drinking opening in the second position; and a second cover attached to the lid to move between a first position and a second position relative to the drinking straw opening, whereby the second cover is configured to preclude liquid from being dispensed from the drinking straw opening in the first position and to allow liquid to be dispensed from the drinking straw opening in the second position, and whereby the lid includes an upper most point and a lower most point, and wherein the drinking straw, while in the drinking straw opening, extends above the upper most point and below the lower most point of the lid.

33. The drinking vessel of claim 32 further comprising a tab on the lid for facilitating removing the lid from the container.

34. The drinking vessel of claim 32 wherein the second cover is positioned within the first cover when the second cover and the first cover are in their first position.

35. The drinking vessel of claim 34 further including a rim on a periphery of the lid having a raised edge around at least a portion of the periphery of the lid.

36. The drinking vessel of claim 35 wherein the first cover rotates about a first point for moving the first cover between its first position and its second position.

37. The drinking vessel of claim 36 wherein the second cover rotates about a second point for moving the second cover between its first position and its second position.

38. The drinking vessel of claim 37 wherein first and second points are the same points.

* * * * *